US005094225A

United States Patent [19]

Craw

[11] Patent Number: 5,094,225

[45] Date of Patent: Mar. 10, 1992

[54] PORTABLE BACK MASSAGER

[76] Inventor: Thomas Craw, 3005 Presidio Cir., Carrollton, Tex. 75007

[21] Appl. No.: 468,161

[22] Filed: Jan. 22, 1990

[51] Int. Cl.[5] ..... A61H 1/00

[52] U.S. Cl. ..... 128/24.3; 128/33; 128/55

[58] Field of Search ..... 128/24.3, 33, 57, 58, 128/48, 49, 51, 55, 56, 25 B

[56] References Cited

U.S. PATENT DOCUMENTS 3,736,920 6/1973 Mathers et al. ..... 128/33

4,154,232 5/1979 Fukazawa ..... 128/52

4,202,326 5/1980 Van Gerpen ..... 128/33

*Primary Examiner*—Robert A. Hafer

*Assistant Examiner*—David J. Kenealy

*Attorney, Agent, or Firm*—Robert M. Sperry

[57] ABSTRACT

An improved massage device which is compact and portable, so as to be conveniently used in an office chair or on or inside of a vehicle seat, and which includes massage means, vibrator means and heating means, together wiht controls for selectably actuating any one or more of these means, as desired.

5 Claims, 2 Drawing Sheets

PORTABLE BACK MASSAGER

BACKGROUND

1. FIELD OF INVENTION

This invention relates to massaging devices and is particularly directed to a portable device for massaging and heating a person's back.

2. PRIOR ART

It is well known that approximately one out of every ten people suffer from some type of back pain, but still manage to function on a day-to-day basis. It is also well known that these back pains are often aggravated by long periods of physical inactivity, such as while driving or working at a desk. Unfortunately, such periods of physical inactivity are frequently required as part of one's employment. However, when a worker is suffering from such back pain, their efficiency will decrease and they will often be irritable, which will have a negative effect on their fellow employees and, hence, on the productivity of the entire organization. Because back pain is such a common problem, numerous attempts have been made heretofore to alleviate or reduce such pain. Thus, since it is known that heat often tends to reduce pain, heating pads are widely used for this purpose. However, heat alone is generally only partially effective. Massage, also, is widely used to alleviate back pain. However, it is obviously impossible or impractical to provide manual massage, on an ongoing basis, for an office worker or for someone driving a vehicle. Numerous types of massage machines have been proposed to meet these needs. Many of the prior art massage devices have been complex and bulky machines which may be appropriate in a gymnasium or a doctor's office, but which are totally unsuited to use in an office or vehicle. Many portable massage devices have been proposed, also. Unfortunately, most of these prior art devices have been passive devices which require a user to rub against the device or to manually rub the device over the area to be treated to obtain massaging action. However, in an office, the squirming or contorted action required to use such devices would be disconcerting to other employees and, for the operator of a vehicle, such actions could be dangerous. Other prior art devices have offered vibration to reduce back pain, but have not combined this with heat or massage. None of the portable massage devices of the prior art offer heat and vibration, as well as motor-driven massage. Thus, none of the prior massage devices have been entirely satisfactory.

BRIEF SUMMARY AND OBJECTS OF INVENTION

These disadvantages of prior art massage devices are overcome with the present invention and an improved massage device is provided which is portable and can conveniently be used in an office or home chair or a vehicle seat and which can provide any desired combination of heat, vibration and motor-driven massage. It is also possible to have the device of the present invention mounted inside the seat of a car, truck or the like.

The advantages of the present invention are preferably attained by providing an improved massage device which is compact and portable, so as to be conveniently used in an office chair or vehicle seat, and which includes massage means, vibrator means and heating means, together with controls for selectably actuating any one or more of these means, as desired.

Accordingly, it is an object of the present invention to provide an improved means for alleviating back pain.

Another object of the present invention is to provide an improved massage device for alleviating back pain.

A further object of the present invention is to provide an improved massage device which is compact and portable, so as to be conveniently used in an office chair or a vehicle seat.

An additional object of the present invention is to provide an improved massage device which can be installed inside the seat of a car, truck or the like.

An additional object of the present invention is to provide an improved device for alleviating back pain which is capable of providing either heat, vibration or massage or any desired combination thereof.

A specific object of the present invention is to provide an improved means for alleviating back pain comprising an improved massage device which is compact and portable, so as to be conveniently used in an office or home chair or vehicle seat, and which includes massage means, vibrator means and heating means, together with controls for selectably actuating any one or more of these means, as desired.

These and other objects and features of the present invention will be apparent from the following detailed description, taken with reference to the figures of the accompanying drawing.

DETAILED DESCRIPTION OF THE INVENTION

Figure 1:
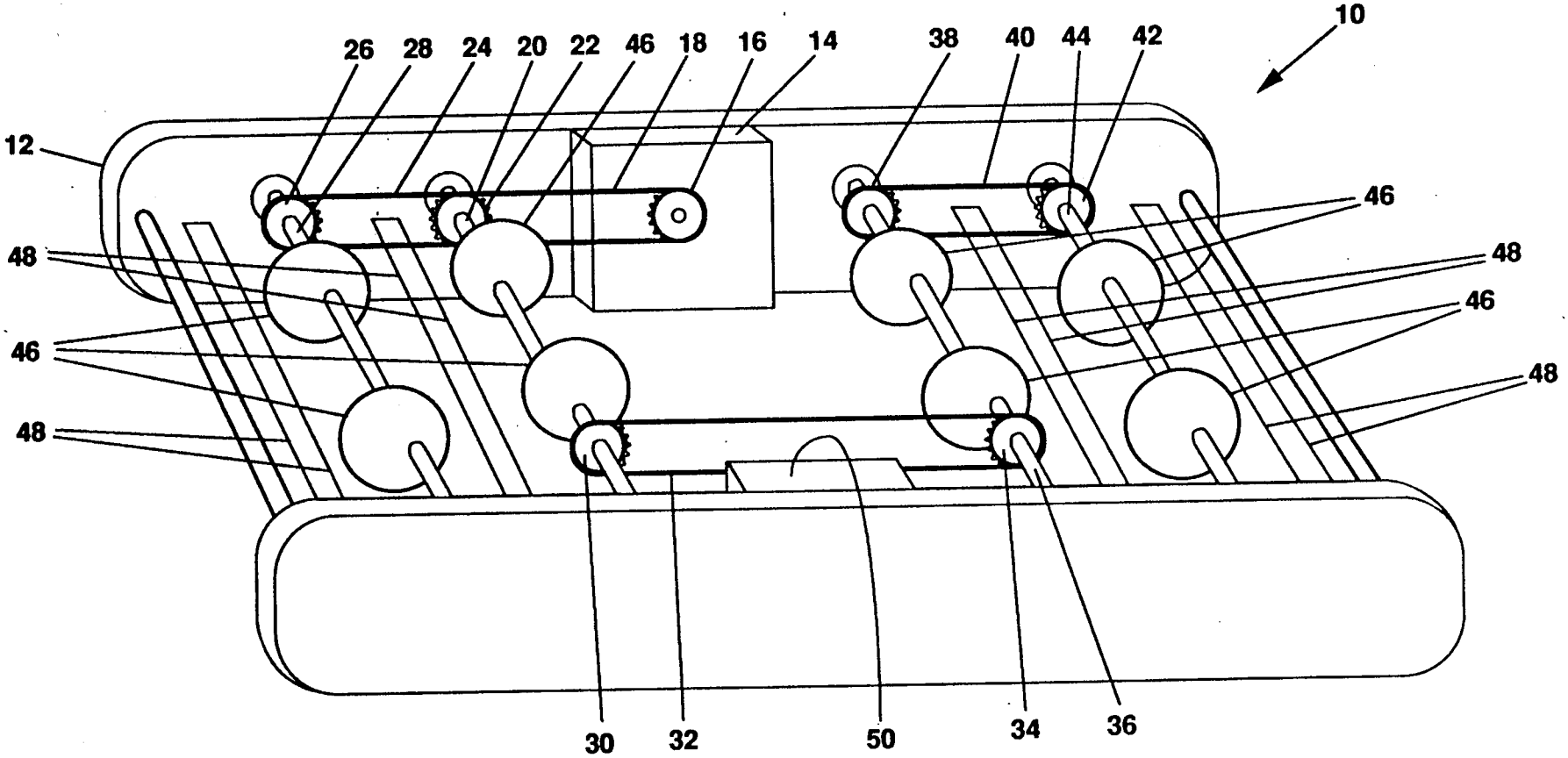
FIG. 1 is an isometric view of a massage device embodying the present invention, shown with the cover removed.

In that form of the present invention chosen for purposes of illustration in the drawing, FIG. 1 shows a massage device, indicated generally at 10 comprising a generally rectangular frame 12. A drive motor 14 is mounted within the frame 12 and serves, when activated, to rotate a sprocket 16, driving a chain 18 which, in turn, rotates sprocket 20 and axle 22. Sprocket 20 is a double sprocket and also serves to drive chain 24 which rotates sprocket 26 and axle 28. In addition, axle 22 carries a second sprocket 30 which serves to drive chain 32 to rotate sprocket 34 and axle 36. Axle 36 also carries sprocket 38 which drives chain 40 to rotate sprocket 42 and axle 44. A plurality of spherical members 46 are mounted, in spaced relation, on each of the axles 20, 28, 36 and 44. Furthermore, the spherical members 46 are mounted eccentrically on the axles 20, 28, 36 and 44 and the spherical members carried by axles 20 and 36 are, preferably, oriented approximately 90° from those carried by axles 28 and 44. In this way, as the axles 20, 28, 36 and 44 rotate, the spherical members 46 will be raised and lowered to provide a massaging action. As described, the members 46 are preferably spherical. However, it will be apparent that the members 46 could be discs or be formed elliptical or of other configuration, if desired. A plurality of heating elements 48 are provided and are located between axle 28 and the adjacent end of the frame 12, between axle 20 and axle 28, between axle 36 and axle 44 and between axle 44 and the adjacent end of the frame 12. Finally, a vibrator motor 50 is mounted on the inside of the frame 12 between axles 20 and 36 and, when activated, serves to vibrate the frame 12.

Preferably, a cloth cover, not shown, is provided enclosing the frame 12. This serves to prevent dust and the like from getting into the mechanism of the massaging device 10. However, it is also possible to enclose frame 12, with all of its electrical and mechanical functions (heat, vibration and motor-driven massage rollers) inside the seat of a vehicle, such as a car, truck or the like, in a manner such that the massage device 10 becomes an integral part of the vehicle seat.

Figure 2:
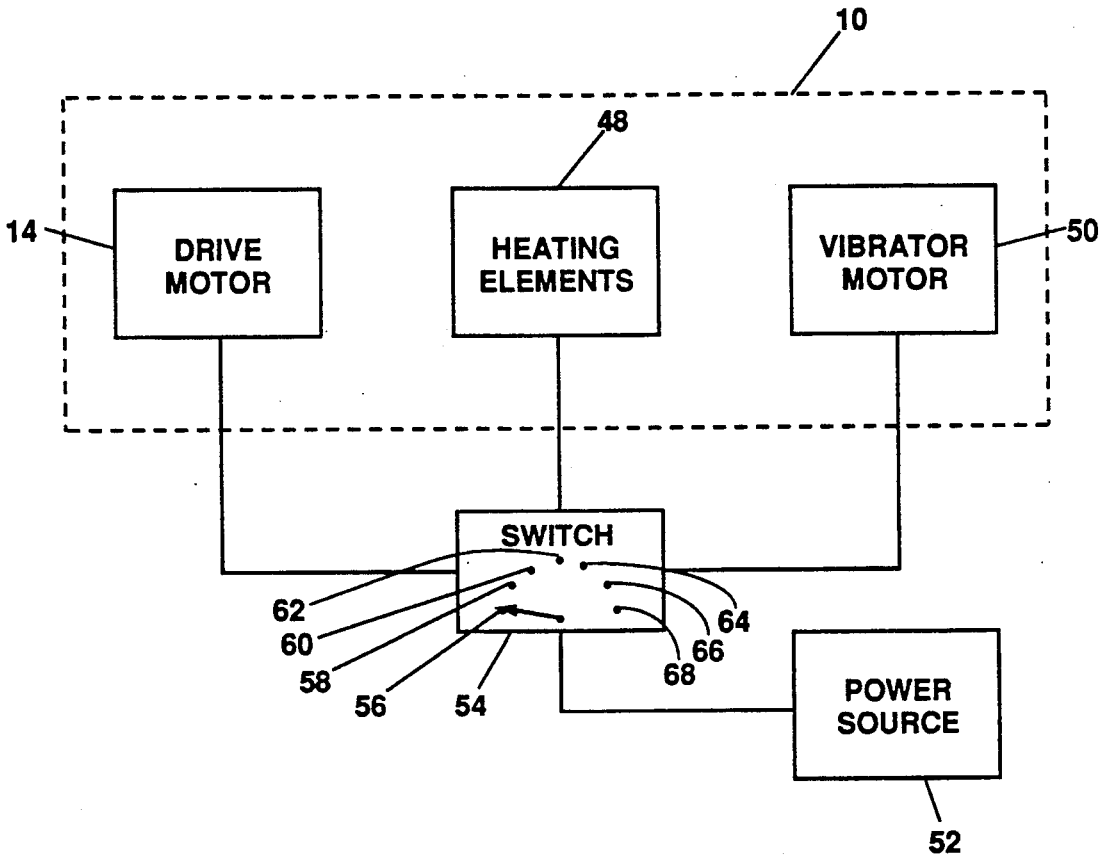
FIG. 2 is a diagrammatic representation of the electrical circuitry of the massage device of FIG. 1.

As seen in FIG. 2, the drive motor 14, heating elements 48 and vibrator motor 50 are energized by a suitable power source 52 through a suitable control switch 54. The power source 52 may be a plug connecting the massage device 10 to line power or to the cigarette lighter of an automobile or the like. Alternatively, the power source 52 may be batteries. In any event, the power source 52 supplies electricity to the switch 54 which passes it through a selected one of the switch points 56, 58, 60, 62, 64, 66, 68 or 70. Switch point 56 passes electricity only to the drive motor 14 to rotate the axles 20, 28, 36 and 44 and spherical members 46 to produce the massaging action only. Switch point 58 passes energy only to the heating elements 48 to provide only heating action, while switch point 60 passes electricity only to the vibrator motor 50 to provide only vibration. Switch point 62 passes electricity to the drive motor 14 and to the heating elements 48 to provide massaging action together with heat. Switch point 64 passes energy to the drive motor 14 and to the vibrator motor 50 to provide massaging action with vibration. Switch point 66 passes electricity to the heating coils 48 and to the vibrator motor 50 to provide vibration with heat. Switch point 68 passes electricity to the motor drive 14, the vibrator motor 50 and to the heating coils 48 to provide massage and vibration with heat. Finally, switch point 70 is the "OFF" position. Thus, by appropriate positioning of the switch 54, the user may select any desired combination of massage, heat and vibration.

In use, the operator places the massage device 10 parallel to the back of their chair or vehicle seat and rests their back against it. Thereafter, by appropriate positioning of the switch 54, they select the desired combination of massaging action, heat and vibration. As noted above, the power source 52 may be batteries or may be a plug connecting the massaging device 10 to electrical energy from a vehicle or power line. Thus, the massaging device 10 is capable of use at home, at a gymnasium, in an office or in a vehicle. Moreover, the massaging device 10 is compact, so that it will fit, inconspicuously, in a chair or vehicle seat to enable a person to use the massage device 10 without embarrassment or inconvenience. Furthermore, the massaging device 10 can, obviously, be used easily by the person suffering back pain without assistance from anyone else. Consequently, the massage device of the present invention is compact and convenient and can easily be used by one person to provide massaging action, heating, vibration or any combination thereof and can readily be switched from one mode of operation to another by simple repositioning switch 54.

Obviously, numerous variations and modifications can be made without departing from the spirit of the present invention. Therefore, it should be clearly understood that the form of the present invention described above and shown in the figures of the accompanying drawing is illustrative only and is not intended to limit the scope of the present invention.

What is claimed is:

1. A massage device comprising:

a frame;

at least one massaging means mounted within said frame;

heating means mounted within said frame;

vibrator means mounted within said frame and actuable to vibrate said frame;

means for selectably activating at least one of said massaging means, said heating means and said vibrator means;

said massage means including a motor, a plurality of axles mounted in spaced relation within said frame each rotatable by said motor, and a plurality of members mounted for eccentric motion about each of said axles and rotatable thereby;

said heating means being mounted to the frame between adjacent ones of said axles and between said axles and adjacent areas of said frame that are parallel to said axles and lying in an area between the plane of said axles and the plane of the adjacent edge of said frame.

2. The device of claim 1 wherein:

said activating means is a power source, and switch means for activating a selected combination of said massaging means, said heating means and said vibrator means.

3. The device of claim 2 wherein:

said power source is at least one battery.

4. The device of claim 2 wherein:

said power source is a plug for connecting said device to an electrical power line.

5. The device of claim 2 wherein:

said power source is a plug for connecting said device to the electrical system of a vehicle.

* * * * *